United States Patent [19]

Helfrich

[11] Patent Number: 4,685,725

[45] Date of Patent: Aug. 11, 1987

[54] SEATING APPARATUS

[76] Inventor: Robert H. Helfrich, 1411 Merced St., Richmond, Calif. 94804

[21] Appl. No.: 734,178

[22] Filed: May 14, 1985

[51] Int. Cl.[4] ..... A47C 4/28

[52] U.S. Cl. ..... 297/45; 297/46; 297/411; 297/441

[58] Field of Search ..... 297/16, 45, 46, 47, 297/441; 52/648

[56] References Cited

U.S. PATENT DOCUMENTS

| | | | |
|---|---|---|---|
| 244,216 | 7/1881 | Fenby . | |
| 1,027,692 | 5/1912 | Cole | 297/45 X |
| 2,691,410 | 10/1954 | Boucher | 297/411 X |
| 2,722,972 | 11/1955 | Altruda | 297/411 X |
| 3,124,387 | 3/1964 | MacLaren | 297/45 X |
| 4,014,591 | 3/1977 | Gittings . | |
| 4,148,520 | 4/1979 | Miller | 297/16 |

FOREIGN PATENT DOCUMENTS

| | | | |
|---|---|---|---|
| 697539 | 9/1953 | United Kingdom | 297/45 |

*Primary Examiner*—Kenneth J. Dorner
*Assistant Examiner*—Peter R. Brown

[57] ABSTRACT

A folding chair providing a lightweight, strong and sturdy chair when unfolded and providing a compact elongated structure when folded. The folding chair invention accommodating arm chair and straddle chair configurations, each of these comprising a frame assembly having a plurality of pivotally connected strut members, and a fabric sling seat supported by the frame assembly. The frame assembly including two crossing interconnected sub assemblies, each sub assembly of four or five strut members. A pivotal stop link being used to stop the unfolding of each sub assembly, each stop link including two parallel shafts pivotally connecting a side member of one sub assembly with a side member of the other sub assembly.

19 Claims, 77 Drawing Figures

SEATING APPARATUS

BRIEF SUMMARY OF INVENTIONS

The inventions herein comprise designs radiating from a first principal invention in folding chair design. This principal invention generally relates to folding chairs of the type having a frame, constructed of a plurality of pivotally connected strut members, supporting a fabric sling seat. This principal invention particularly relates to the manner in which the side members of such a chair frame are positioned with relationship to one another on a nominally vertical plane. Arm chairs and straddle chairs may be constructed utilizing this principal invention. Three species of the principal invention are described, each of these being a different manner of positioning the frame side members with relationship to one another on a horizontal plane. Three methods of pivotally connecting the frame members are described. Two methods of stopping the unfolding of the frame are described.

Other inventions radiating from this principal invention include the following.

(1) A folding footrail is effected on high versions of the chairs utilizing an improved furniture brace scissor hinge.

(2) A folding baby stroller is effected by adding handles and wheels to versions of either the arm chair or straddle chair.

(3) A folding rocking chair is effected by adapting members of the straddle chair frame.

(4) An improved tablet arm is effected on the arm chair. The improvement allowing it to fold around the folded chair.

(5) An improved folding sling seat is effected for use on both the arm chair and straddle chair. The improvement allowing a semi inflexible material seat to fold compactly upon the folded chair frame.

(6) An additionally improved folding sling seat is effected for use on the arm chair. The improvement offering conversion from a seat offering conventional feet on the floor seating position to a seat offering unconventional cross legged feet off the floor lotus seating position.

(7) A half breed chair is effected combining qualities of both the arm chair and straddle chair. This chair having one arm and the potential for straddle seating on the chair side opposite that with the arm.

The chairs described may be constructed of renewable resources. Their simple construction requiring relatively small energy consumption in their manufacture.

DESCRIPTION OF DRAWINGS

Figure 1:
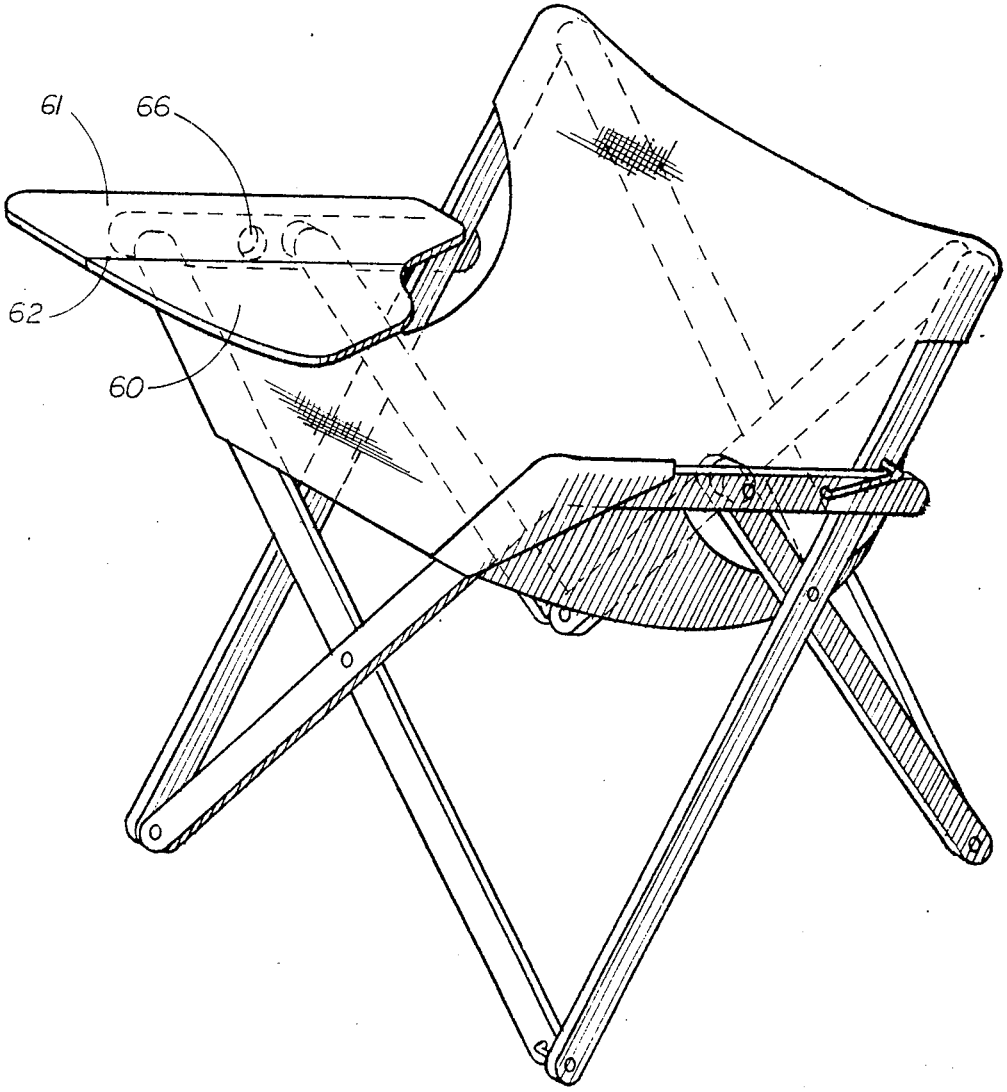

FIG.

1—Tablet arm chair, 10 member frame, first use position, isometric view,

2—Arm chair, 10 member frame, diagram view.*

3—Arm chair seating position, diagram view.

4—Start of folding arm chair, diagram view.*

5—Finish of folding arm chair, diagram view.

6—Arm frame, first sub assembly, diagram plan view.

7—Folded arm frame, first sub assembly, diagram view.

8—Arm frame, second sub assembly, diagram plan view.

9—Arm frame assembly, 8 member, diagram plan view.

10—Folded arm frame, 8 member, diagram view.

11—Arm frame, 8 member, diagram view.

12—Arm chair, 8 member frame, diagram view.*

13—Arm frame, 8 member, diagram view.

14—Arm frame, 10 member, diagram view.

15—Folded arm frame, 10 member, diagram view.

16—Arm frame A, 10 member, isometric view.

17—Frame A, pivotal connection at pts. 5 & 6, exploded view.

18—Frame A, unfolding stop at pts. 7 & 8, exploded view.

19—Frame A, pivotal end of member connection at pts. 10–17, exploded view.

20—Folded arm frame A, 10 member, isometric view.

21—Arm frame B, 10 member, isometric view.

22—Folded arm frame B, 10 member, isometric view.

23—Arm frame C, 10 member, isometric view.

24—Frame C, pivotal end of member connection at pts. 10–17, exploded view.

25—Folded arm frame C, 10 member, isometric view.

26—Straddle chair, 10 member frame, diagram view.*

27—Straddle chair seating position, diagram view.

28—Straddle frame, first sub assembly, diagram plan view.

29—Straddle frame, second sub assembly, diagram plan view.

30—Straddle frame assembly, 8 member, diagram view.

31—Folded straddle frame, 8 member, diagram view.

32—Straddle frame, 8 member, diagram view.

33—Straddle frame, 8 member, diagram view.

34—Straddle frame, 8 member special case, diagram view.

35—Straddle chair, 8 member special case, diagram view.*

36—Straddle chair seating position, special case, diagram view.

37—Straddle chair, 8 member frame, diagram view.*

38—Straddle frame, 10 member, diagram view.

39—Folded straddle frame, 10 member, diagram view.

40—Straddle frame A, 10 member, isometric view.

41—Folded straddle frame A, 10 member, isometric view.

42—Staddle frame B, 8 member special case, isometric view.

43—Folded straddle frame B, 8 member special case, isometric view.

44—High arm chair with footrail, diagram view.

45—Footrail on frame A, unfolded, isometric view.

46-Footrail on frame A, partially folded, isometric view.

47—Footrail on frame A, folded, isometric view.

48—Baby stroller, 10 member arm frame, diagram view.

49—Folded baby stroller, 10 member arm frame, diagram view.

50—Straddle rocking chair, 10 member frame, diagram view.

51—Folded straddle rocking chair, 10 member frame, diagram view.

52—Tablet arm chair, first use position, diagram view.

53—Tablet arm, ½ way to second use position, diagram view.

54—Tablet arm, connection to member B, frame A, exploded view.

55—Tablet arm, second use position, diagram view.

56—Tablet arm, chair folded, second use position, diagram view.

57—Tablet arm, chair folded, ½ way to third use position, diagram view.

58—Tablet arm, chair folded, third use position, diagram view.

59—Tablet arm chair, carrying position, diagram view.

60—Planar fold sling, on unfolded arm frame, diagram view.

61—Planar fold sling, ⅓ folded, diagram view.

62—Planar fold sling, ⅔ folded, diagram view.

63—Planar fold sling, folded on arm frame, diagram view.

64—Planar fold sling pattern, plan view.

65—Knee socket sling, unconverted, on unfolded arm frame, diagram view.

66—Knee socket sling, ⅓ converted, diagram view.

67—Knee socket sling, ⅔ converted, diagram view.

68—Knee socket sling, converted, diagram view.

69—Knee socket sling, seating position when on arm frame, diagram view.

70—Knee socket sling pattern, plan view.

Figure 52:
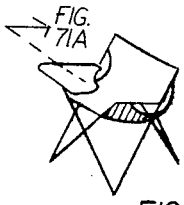
Figure 55:
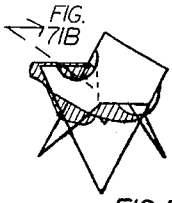
Figure 58:
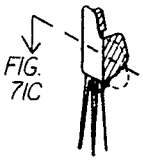

71—Tablet arm, three use positions, sect. views from FIGS. 52, 55 and 58.

Figure 63:
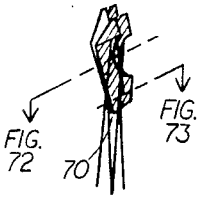

72—Planar fold sling, folded on frame A, sectional view from FIG. 63.

73—Planar fold sling, folded on frame A, sectional view from FIG. 63.

Figure 65:
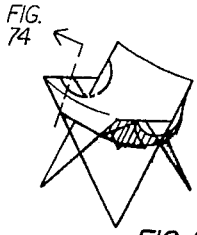
Figure 66:
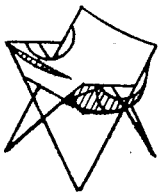

74—Knee socket, folded flat unconverted, sectional view from FIG. 65.

Figure 68:
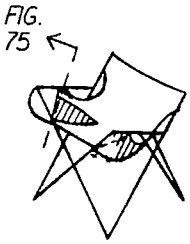

75—Knee socket, converted and expanded, sectional view from FIG. 68.

76—Half breed chair, 10 member frame, diagram view.

Figure 23:
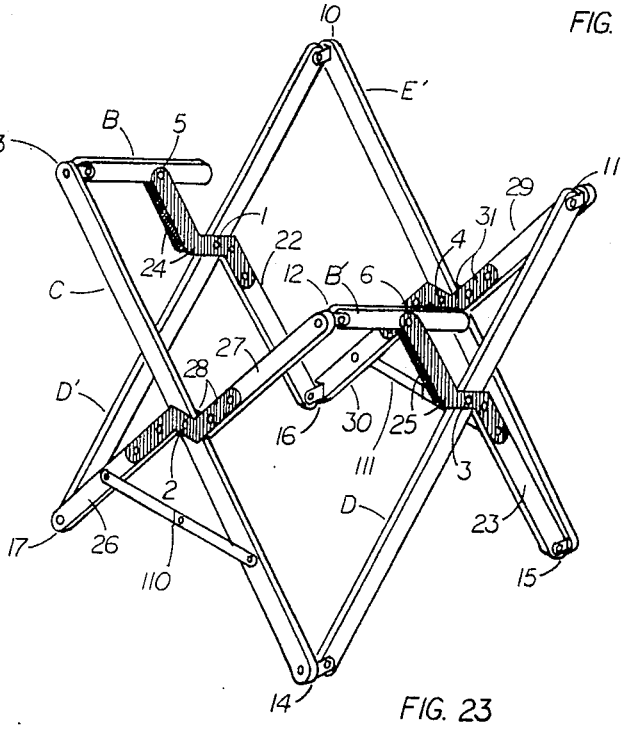

77—Frame C unfolding stop hinge, as on FIG. 23, isometric view.

*Dotted line represents pockets on sling back for supporting frame.

DESCRIPTION OF INVENTIONS

FOLDING ARM CHAIR
- Arm Chair Frame A
- Arm Chair Frame B
- Arm Chair Frame C

FOLDING STRADDLE CHAIR
- Straddle Chair Frame A
- Straddle Chair Frame B

HIGH CHAIR FOOTRAIL
BABY STROLLER
ROCKING CHAIR
FOLDING TABLET ARM
PLANAR FOLD SLING
KNEE SOCKET SLING
HALF BREED CHAIR

FOLDING ARM CHAIR

Figure 2:
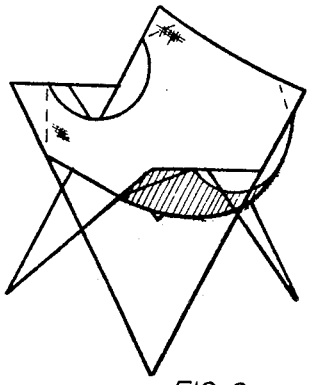
Figure 5:
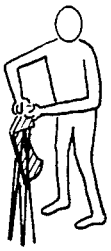

The folding arm chair comprises a folding frame which effects arms, and a sling seat (FIG. 2). The chair folds compactly into an elongated form (FIG. 5).

Using the Arm Chair

Figure 3:
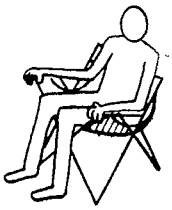
Figure 4:
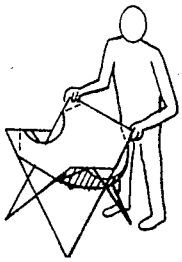

Seating position in this chair is with feet on the floor with arms on arm rests (FIG. 3). The chair is folded from behind, grasping the two outward upper points of the back (FIG. 4) and pushing them together (FIG. 5.) The chair is opened in the reverse order.

Figure 6:
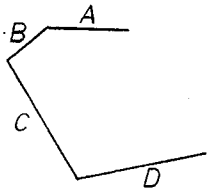

Making the Arm Chair (1) Pivotally connect four members A,B,C and D to form a frame sub assembly (FIG. 6).

Figure 7:
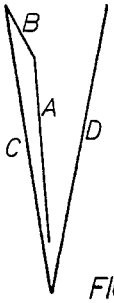

(2) Such that this frame sub assembly can fold with all members being relatively parallel (FIG. 7).

Figure 8:
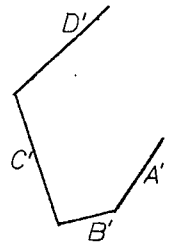

(3) Pivotally connect four members A′,B′,C′ and D′ to form a second frame sub-assembly, this sub assembly being composed of like members and mirror image assembly to the first sub assembly (FIG. 8).

Figure 9:
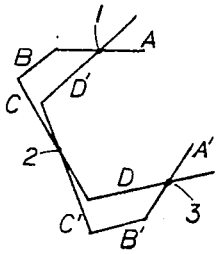

(4) Interlace the two frame sub assemblies such that they cross and pivotally connect at three points intermediate the ends of the connecting members (FIG. 9; 1, 2, 3).

Figure 10:
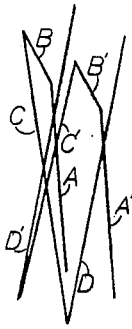

(5) The eight member frame described can fold into a compact elongate form wherein all members are substantially parallel (FIG. 10).

Figure 11:
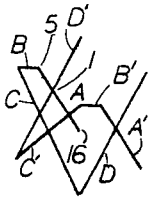

(6) Such that when unfolded to the form desired to effect a chair frame the the connection of members A and B (5) is above the connection of members A and D′ (6), such as to produce a result of members B and B′ being used as chair arms (FIG. 11).

Figure 12:
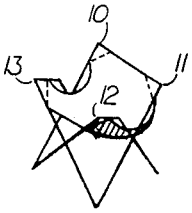

(7) A fabric sling slung from 10, 11, 12 and 13 provides a seat (FIG. 12).

Figure 13:
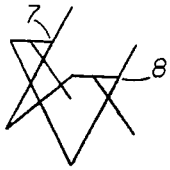

(8) Additional chair frame stability and a means for stopping unfolding of the frame, in addition to that provided by the sling seat, can be achieved by extending members B and B′ to crossings with D′ and D respectively (FIG. 13; 7, 8).

Figure 14:
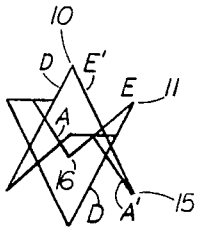

(9) Additional chair frame stability can be achieved by adding a crossed pair of pivotally connected, equal length members E and E′ to the unattached ends of members A,D,A′ and D′ respectively (FIG. 14; 10, 11, 15, 16).

Figure 15:
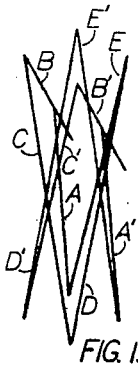

(10) The ten member frame described can fold into a compact elongate form wherein all members are substantially parallel (FIG. 15).

Three preferred ways of making the arm chair frame follow; Arm Chair Frames A, B and C. Each of these comprises a different way of positioning the side members of the frame with respect to one another. Each of these further comprises a different way of pivotally connecting the members of the frame.

Arm Chair Frame A

Figure 16:
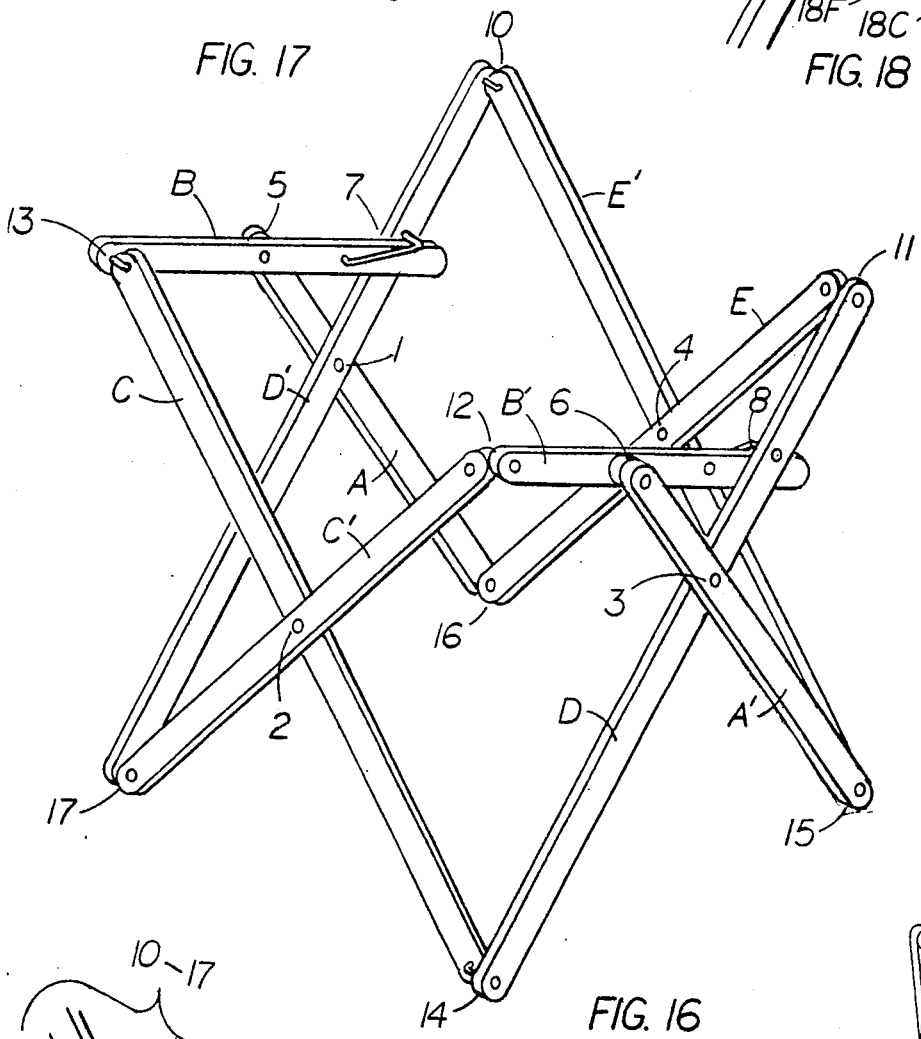

Arm chair frame A may be constructed of bar or tubular members. A preferred version is with ten wooden bar members A,B,C,D,E,A′,B′,C′,D′, E′ (FIG. 16). The illustrated example is a reduction to practice of the diagrammatic frame illustration FIG. 14.

Figure 53:
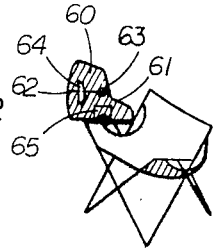
Figure 54:
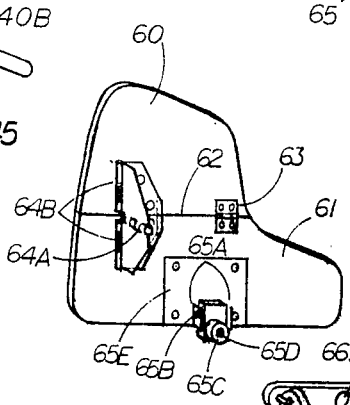
Figure 54:
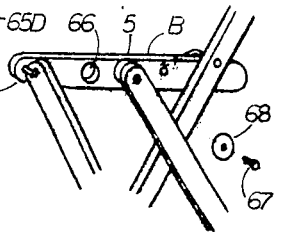

Members A and A′ are positioned on opposite sides of D′ and D from B and B′ respectively. This condition may be effected wherein B and B′ are inside of D′ and D respectively (FIG. 16), or wherein B and B′ are outside of D′ and D respectively (FIGS. 1, 54). The former positioning effects a more compactly folded form (FIG. 20) than the latter. The latter positioning effects an ability for accessory items to be attached to members B and/or B′ such as to fold with and around the frame. See tablet arm (FIGS. 52–58).

Figure 19:
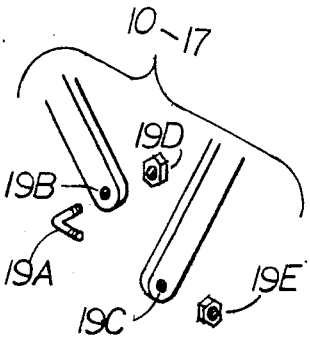

The end connections of members at points 10–17 are double pivotal, such as to permit the members so attached to pivot about these connections on two axes approximately 90 degrees one to another, such as to permit the frame sub assembly, of which they are a part, to fold. A preferred form of this connection is composed of a rigid bar bent at approximately 90 degrees, with two threaded ends (FIG. 19; 19A). These ends are inserted through drilled holes (19B,19C) at the ends of two typically attached members. The bent bar threaded ends are capped with lock nuts 19D and 19E. The required pivoting action, such as to allow the frame to fold, is effected about those portions of the bar inserted through the two members.

Figure 17:
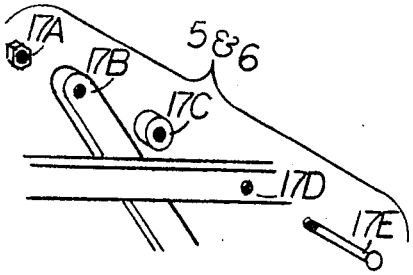

The end connections of members A and A' to members B and B' respectively (5,6) are pivotal. A preferred form of these connections consists of a threaded bolt (FIG. 17; 17E) inserted through holes 17D and 17B in the attached members and through a hole 17C in a spacer separating the two members. The bolt is capped with a lock nut 17A. The spacer is cylindrical, with a hole through its center 17C. The spacers are of the same thickness as members D and D', so as to sufficiently separate the respective members they are spaced between, so as to allow these members to freely pivot to fold their frame sub assemblies to a compact form unrestrained therein from contact with members D and D'.

Figure 20:
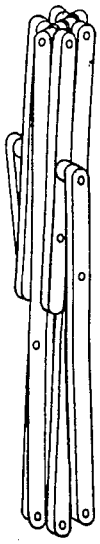

The interconnections of the two frame sub assemblies, one to another, are at points intermediate of the ends of the members on which the connections occur (1,2,3,4). These connections are pivotal, such as a rivet. These are such as to allow the members they connect to pivot so as to permit the two frame sub assemblies to fold together to that position wherein all members are relatively parallel (FIG. 20).

Figure 18:
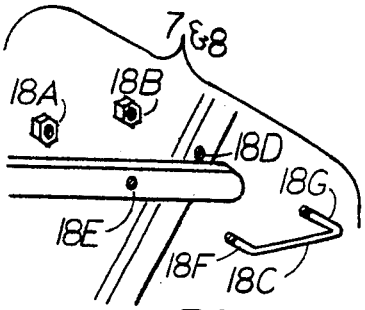

A means for stopping unfolding of the frame assembly is effected at the crossing of members B and D', and B' and D (7,8). A preferred form of this means uses a rigid rod or wire bent to form two parallel spaced apart projecting shafts (FIG. 18; 18F, 18G). The shafts are inserted thru holes (18E,18D) in the members B,B' and D', D respectively, intermediate the lengths of the members. Lock nuts (18A, 18B) are attached to the threaded ends of the shafts, thereby connecting the shafts to the frame members. The members B, B' and D', D pivot about these shafts in folding and unfolding. The length of the rod 18C between the shafts 18F and 18G being sufficient to allow the shaft connected frame members to pivot about the shafts to folded positions wherein all members are relatively parallel (FIG. 20). In unfolding the shaft connected frame members pivot about the shafts to that point where B and B' frame members abut a shaft (FIG. 18; 18G) stopping the unfolding of the frame assembly (FIG. 16; 7,8).

Arm Chair Frame B

Arm chair frame B may be constructed of bar or tubular members. A preferred version is with ten rigid round tubes such as metal or bamboo (FIG. 21; A,B,C,-D,E,A',B',C',D',E'). The illustrated example is a reduction to practice of the diagrammatic frame illustration FIG. 14.

Figure 21:
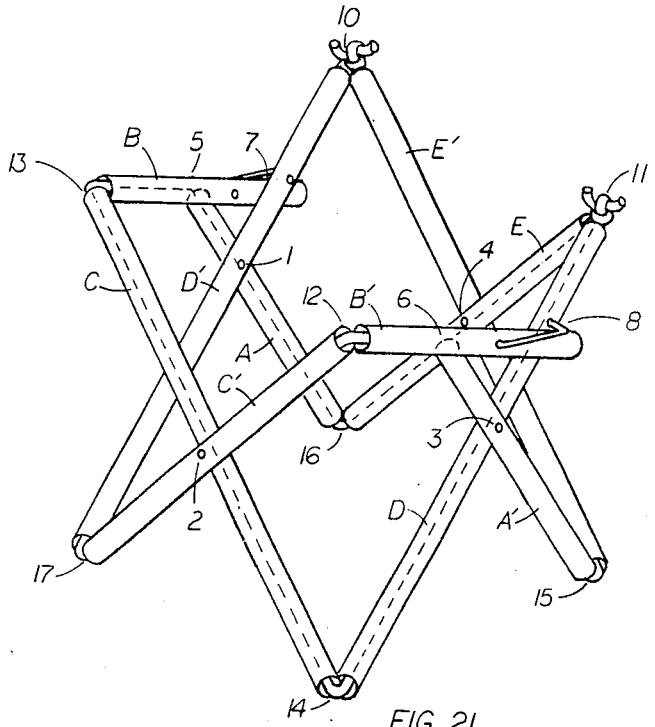

Members A and B, and A' and B' are positioned on the same side of D' and and D respectively. They may be so positioned on the inside or outside of D' and D. A preferred form of positioning is when they are on the outside (FIG. 21). In this position members B and B' may be readily adapted to accommodate accessory items, which can fold with and around the frame. See tablet arm (FIGS. 52–58).

In this frame the members of the two frame sub assemblies are connected, one to another, by a flexible material such as a rope. The rope running continuously through the frame sub assembly member tubes, being knotted at its ends (10 and 11). The path of one of such ropes through one of the frame sub assemblies is indicated by dotted line (FIG. 21). To accommodate this condition at the connection of members A to B, and A' to B' holes are drilled through the tubular wall of members B and B' to allow the rope to pass through the hole at connections at points 5 and 6. Such a connection system performs the functions of connecting the members of each respective sub assembly, and of allowing these members to pivot to fold about the shaft of rope at each connection where it passes from one member tube to the other.

Figure 22:
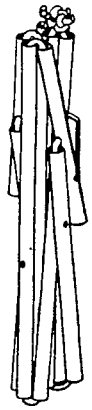

The two frame sub assemblies are interconnected at four points intermediate of the ends of the members so interconnected (FIG. 21; 1, 2, 3, 4). These interconnections are pivotal, such as a rivet. These allow the two frame sub assemblies to pivot about these interconnections such as to allow the total chair frame to fold compactly (FIG. 22).

A means for stopping unfolding of the frame assembly is effected at the crossing of members B and D', and B' and D (FIG. 21; 7,8). The detailing and effect of this condition is as expressed and illustrated for the arm chair frame A.

Arm Chair Frame C

Arm chair frame C may be constructed of bar or tubular members. A preferred version is with ten members (FIG. 23; A,B,C,D,E,A',B',C',D',E'). The illustrated example is a reduction to practice of the diagrammatic frame illustration FIG. 11, with the addition of the crossed members E and E'.

Frame members B,C,D,B',D',E' are rigid wooden bars. Frame members A, A', C', E are each assemblies of sub members. Each of these assemblies is composed of one or two sub member bars and a pair of sub member rigid gusset plates, such as metal, of a form similar to the letter Z. Members A and A' are each composed of 1 sub member bar and pair of plates (FIG. 23: 22,24; 23,25 respectively). Members C' and E are each composed of two sub member bars and pair of plates (FIG. 23: 26,27 28; 29,30,31 respectively). The pair of plates is attached to both sides of the sub member bar on the bottom of the figurative letter Z shaped plates in the case of the former members by a plurality of rivets in sufficient number to form a rigid mem The pair of plates is attached to both sides of the sub member bars on the Z shaped plates' top and bottom in the case of the latter members by a plurality of rivets if sufficient number to form a rigid member.

The members A,B,D' comprise one side of the frame. The members A', B', D comprise a second side of the frame. The members on the first side are positioned on essentially the same plane as one another. The members on the second side are positioned on essentially the same plane as one another.

Figure 24:
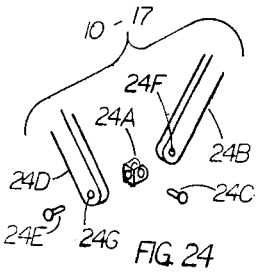

The end connections of members at pts. 10–17 (FIG. 23) are double pivotal, such as to permit pivoting of the connected members on two axes, the axes being positioned in 90 degree angular relationship to one another. A preferred form of this connection consists of a rigid plate collar, such as metal (FIG. 24; 24A), the collar having two parallel flanges, the flanges being spaced apart and projecting perpendicularly from a collar web. Each flange and the web having a hole. A typically attached member at these connections (24B), representing members A,A',B,B',D,D', is connected to the collar with a rivet. An end of this typical member being positioned between the collar flanges. The rivet connector (24C) passing sequentially thru the hole in one collar flange, then through a hole in the end of typically attached member (24F), and then through a hole in the second collar flange. This rivet forms the first of the two axes. The second axis is formed by a rivet (24E) which connects the collar web to the second typically attached member (24D), this member representing members C,C',E,E'. The rivet passes through a hole (24G) in an end of the second typically attached member, and then passed through a hole in the collar web. Members A,A',B,B',D,D' pivot about the first rivet, such as to permit folding and unfolding of the frame sub assembly of which each is a part. Members C, C',E, E' pivot about the second rivet axis, such as to permit folding and unfolding of the frame sub assembly of which each is a part.

The end connections of members A and A' to members B and B' respectively (FIG. 23; 5,6) are pivotal. In these connections members B and B' are each positioned, respectively, between the A and A' sub member pair of gusset plates, at the end of the top part of the figurative letter Z plates furthest from the middle part of the figurative Z. The position of this connection being intermediate the ends of members B and B'. The means of connection being a rivet, the rivet passing through a hole in one gusset plate, then passing through a hole in the member B or B', and then passing through a hole in the other of the pair of gusset plates. These connections allow the members and sub members, thusly connected, to pivot about the rivet axis, such as to allow the sub assembly of which they are a part to fold and unfold.

Figure 25:
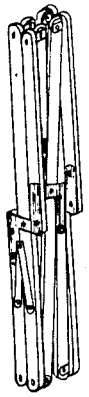

The interconnections of the two frame sub assemblies, one to another (FIG. 23; 1,2,3,4), are at points intermediate of the ends of the members forming the interconnections. The members interconnecting at these points are on the same plane as one another. This condition is effected by inserting members D', C, D, E' between the pair of previously discussed gusset plates of members A, C',A',E' respectively, at the middle part of the figurative letter Z plates. A rivet interconnects the members. These sub assembly interconnections allow the sub assemblies to pivot about the axes of the interconnecting rivets, such as to allow the frame assembly to fold and unfold. The folded form of the frame assembly being compact, with all members therein being relatively parallel (FIG. 25).

Figure 77:
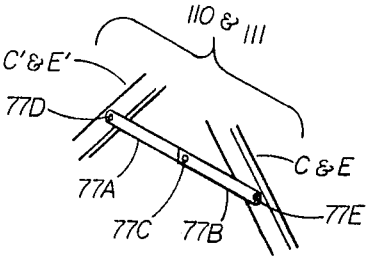

Chair frame unfolding stops (FIG. 23; 110,111) are effected at the front and back of the chair. They connect members C and C' at said front below pt. 2, and connect members E and E' at said back, below pt. 4. Each of these two stops consists of a rigid scissor hinge of two leaves (FIG. 77; 77A,77B), pivotally connected at one of their ends by a rivet (77C). Leaf 77A is pivotally connected at the other of its ends by a rivet (77E) to member C or E. In the folded form of the chair frame these hinge leaves are relatively parallel (FIG. 25). As the frame unfolds these leaves pivot about said connections to that position wherein they are disposed at 180 degrees, one to another; at which point they stop the chair frame from further unfolding (FIG. 23).

FOLDING STRADDLE CHAIR

Figure 26:
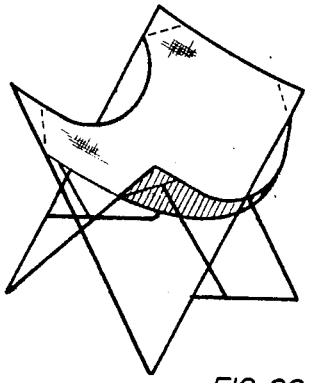

The folding straddle chair comprises a folding frame which effects straddle seating potential, and a sling seat (FIG. 26). The chair folds compactly into an elongated form.

Using the Straddle Chair

Figure 27:
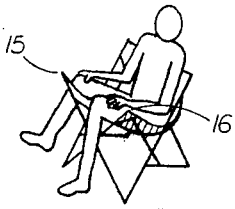

Seating position in this chair is as illustrated for the arm chair in FIG. 3, with legs forward and feet on the floor, or as in FIG. 27, where one or the other leg may straddle pts. 15 or 16. The chair is folded from behind, grasping the two outward upper points of the back and push them together, similar to FIGS. 4 and 5. The chair is opened in the reverse order.

Figure 28:
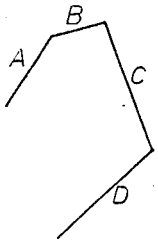

Making the Straddle Chair (1) Pivotally connect four members A,B,C, and D to form a chair frame subassembly (FIG. 28).

Figure 29:
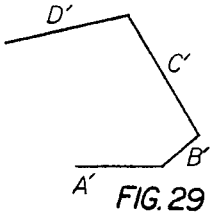

(2) Pivotally connect four other members A',B',C', and D' to form a second frame sub assembly of like members and mirror image assembly to the first sub assembly (FIG. 29).

Figure 30:
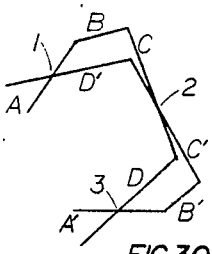

(3) Interlace the two frame sub assemblies such that they cross at 3 points intermediate of the ends of the crossing members (FIG. 30; 1,2,3) and pivotally connect at pt. 2.

Figure 31:
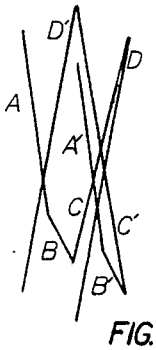

(4) The eight member frame described can fold into a compact elongate form wherein all members are substantially parallel (FIG. 31).

Figure 32:
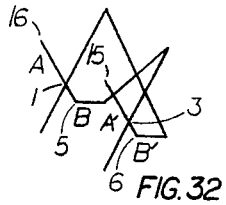

(5) Such that this frame can unfold to the form desired to effect a chair frame, the connection of members A and B (5), and of members A' and B' (6) being below the crossing of members A and D' (1), and of members A' and D (3) FIG. 32.

Figure 33:
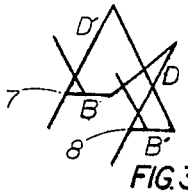

(6) Chair frame stability and a means for stopping unfolding of the frame, in addition to that means of stopping provided by the sling seat, is achieved by extending members B and B' to crossings with members D' and D respectively (FIG. 33; 7,8).

Figure 34:
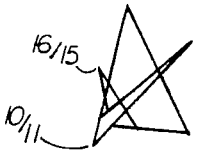

(7) A special case of this chair is that wherein members A and A' pivotally connect at pt. 16/15 (FIG. 34).

Figure 35:
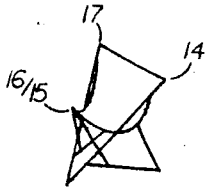

(8) Such as to form a frame for a sling seat slung from pts. 17, 14, and 16/15 (FIG. 35).

Figure 36:
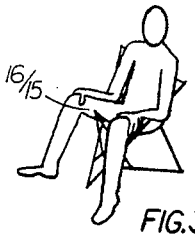

(9) Seating position in this chair is with the legs straddling the connection of members A and A' (FIG. 36; 16/15).

Figure 37:
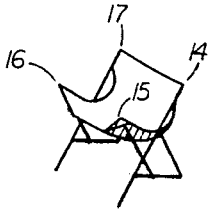

(10) In the general case of the frame, as shown in FIG. 33, a fabric sling slung from pts. 14,15,16,17 provides a seat (FIG. 37).

Figure 38:
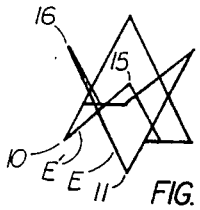

(11) Additional chair frame stability can be achieved by adding a crossed pair of pivotally connected, equal length members E and E' (FIG. 38; 4) to the ends of members A,D,A',D' respectively (FIG. 38; 10,11,15,16).

Figure 39:
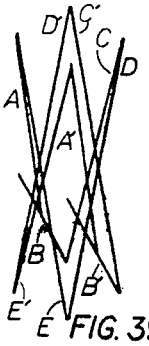

(12) The ten member frame described can fold into a compact elongate form wherein all members are substantially parallel (FIG. 39).

Two preferred ways of making the straddle chair frame follow; Straddle Chair Frames A and B. Each of these comprises a different way of positioning the side members of the frame, and a different way of pivotally connecting the ends of the members.

Straddle Chair Frame A

Figure 40:
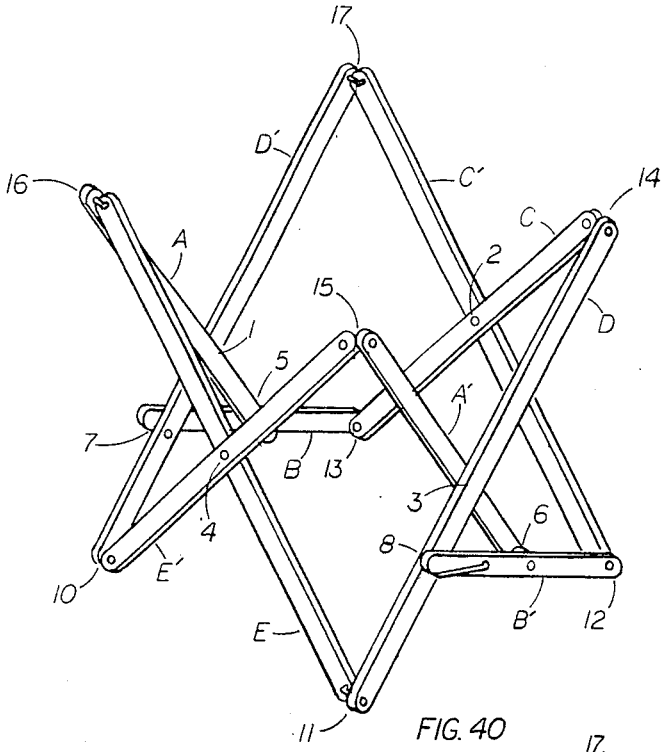

Straddle chair frame A may be constructed of bar or tubular members. A preferred version is with ten wooden bar members A,B,C,D,E,A',B',C',D', E' (FIG. 40). The illustrated example is a reduction to practice of the diagrammatic frame illustration FIG. 38.

Members A and A' are positioned on opposite sides of D' and D from B and B' respectively. A preferred form of this condition is where A and A' are on the inside of D' and D respectively, and where B and B' are on the outside of D' and D respectively (FIG. 40).

The end connections of members at points 10–17 are double pivotal, such as previously described for arm chair frame A. The operation of these connections is also as described for arm chair frame A.

The end connections of members A and A' to members B and B' respectively (5,6) are also as described for arm chair frame A, with the exception that in this case these members are reversed in their relationship about members D' and D respectively. The operation of these connections is also as described for arm chair frame A.

Figure 41:
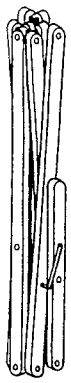

The interconnections of the two frame sub assemblies, one to another, are at points intermediate of the ends of the members on which the connections occur (FIG. 40; 2,4). These connections are such as to allow the members they connect to pivot so as to permit the two frame sub assemblies to fold together to that position wherein all members are relatively parallel (FIG. 41).

An unfolding stopping means is employed on this frame as previously described and illustrated for arm chair frame A (viz. FIG. 18), with the exception that in this case it is inverted. As such it permits the chair to fold completely and unfold to the position desired to best serve as a straddle chair frame.

Straddle Chair Frame B

Figure 43:
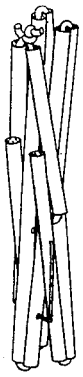

Straddle chair frame B may be constructed of bar or tubular members, in eight or ten member versions. A preferred version is with eight rigid round tubular members, such as metal or bamboo, A,B,C,D,A',B',C', D' (FIG. 43). This is a reduction to practice of the diagrammatic frame illustration FIG. 34.

Members A and B, and A' and B' are positioned on the outside of members D' and D respectively.

In this special case of the straddle chair members A and A' are connected to one another at their ends (FIG. 42; 16/15) as are members D and D' (10/11). This frame is composed of three sides. On one of these sides lie members A, B and D'; on another side lie members A',B' and D; on the third side lie members C and C'. The members of the two sub assemblies are connected one to another by means of a flexible connector such as rope. The path of the connecting rope is as follows: the rope enters tube member A at its connection with member B (5) intermediate the length of B, where it passes from the end of A to B through a hole in the tubular wall of B, passing therefrom through the length of B to its connection to C (13), where it passes from the end of B into the end of C, passing therefrom through the length of C to its connection to D (14), where it passes from the end of C into the end of D, passing therefrom the length of D to it's connection with D' (10/11), where it passes from the end of D into the end of D', passing therefrom the length of D' to it's connection with C' (17), where it passes from the end of D' to the end of C', passing therefrom the length of C' to it's connection with B' (12), where it passes from the end of C' into the end of B', passing therefrom the length of B' to it's connection with A'(6), intermediate the length of B', where it passes from B', through a hole in the tubular wall of B', into the end of A', passing therefrom the length of A' to it's connection with A (16/15), where it passes out of A' and is tied in a knot connection with its other end. These connections permit the members so attached to pivot about the flexible rope where it passes from one tube to another, such as to fold the frame assembly.

Members C and C' are connected intermediate the ends of the members (2) at that point where the members cross. This connection is pivotal, such as a rivet. It allows the members so connected to pivot such as to allow the frame to fold.

Figure 42:
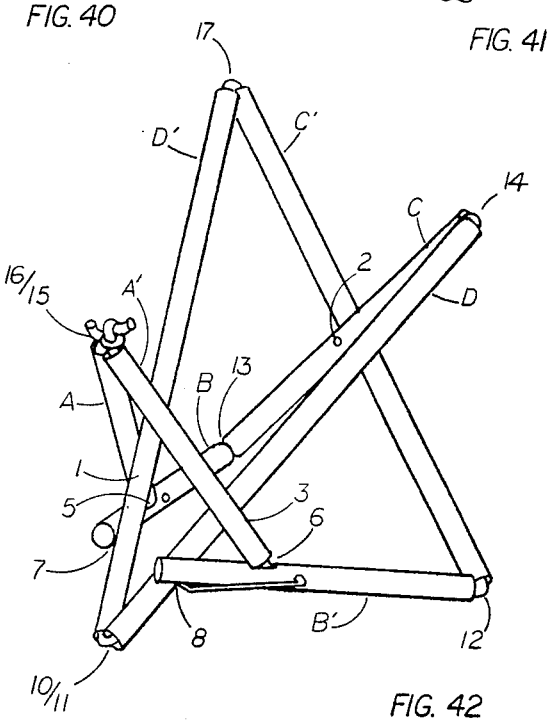

An unfolding stopping means is effected at the intersections of members B and D', and B' and D (7,8). The detailing and effect of this condition is similar to that described for arm chair frame A. As such the frame can fold to a compact form with all members relatively parallel (FIG. 43) and unfold to the position desired to serve as a chair frame (FIG. 42).

HIGH CHAIR FOOTRAIL

Figure 44:
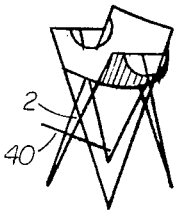
Figure 45:
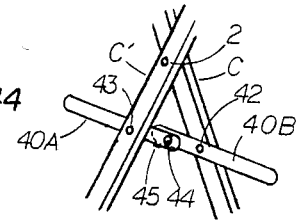
Figure 46:
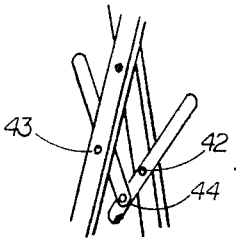
Figure 47:
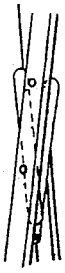

In higher versions of the arm chair than those previously described a footrail may be added for seating comfort. This is effected by positioning a scissor hinge (FIG. 44; 40) between, and attached to, members C and C' below their intermediate member connection (2). This hinge consists of 2 rigid leaves, such as metal (40A, 40B), one each pivotally connected to member C and C', such as with a rivet (42, 43). The hinge leaves are pivotally connected, such as with a rivet (44). One of these leaves, such as the one connected to member C (40B), has a strike plate of rigid metal extending outwardly from the bottom edge of the hinge leaf (45) at a 90 degree angle from the plane on which the hinge pivots, at a point on that leaf on the opposite side of the hinge pivot (44) from its connection with member C (42). In addition both hinge leaves extend sufficiently past their respective connections with members C and C' (42,43) from their common pivot point (44), such as to serve as footrails. When being unfolded and with weight being applied downwardly on these footrails, they pivot about their common pivot to that degree wherein they are disposed at approximately 180 degrees, one to another. At that point the previously described strike plate strikes the bottom edge of the other leaf, which is mounted outwardly from the former leaf. This strike action stops further rotation of the hinge leaves, thereby effecting a relatively rigid horizontal footrail. As the chair is folded, the leaves of the hinge pivot to fold about their common pivot point (FIG. 46; 44) and their connections with members C and C' (42,43) such that when the chair is completely closed the leaves are relatively parallel and therefore compactly folded (FIG. 47).

BABY STROLLER

Figure 48:
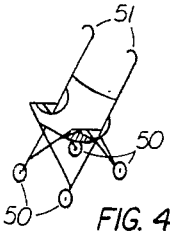
Figure 49:
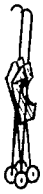
Figure 56:
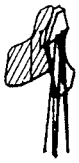

The previously described chair frame invention can be applied to the form of a baby stroller in both the arm chair and straddle chair configurations. In the arm chair frame A version thereof, wheels (FIG. 48; 50) are added to extensions of members A,A',D and D' past their respective end connections with E,E', C and C' respectively. In addition members D and D' are extended past their respective end connections with members E and E' for the purpose of applying handles (51) for pushing and carrying. A folded version of this chair is illustrated (FIG. 49) wherein all members are folded relatively parallel one to another.

ROCKING CHAIR

Figure 50:
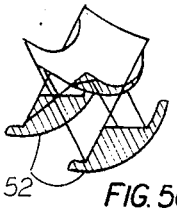
Figure 57:
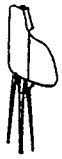
Figure 51:
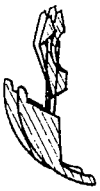

The straddle chair may be adapted to the form of a rocking chair which folds. This is done by replacing members B and B', which have been previously described as bars or tubes, with rockers (FIG. 50; 52). The folded form of this chair is shown in FIG. 51.

FOLDING TABLET ARM

A preferred version of the arm chair includes a folding tablet arm work surface (FIG. 1). The properties of use of this device are that it be flat, substantially rigid and horizontal, providing elbow and forearm support for one arm, with sufficient surface area for writing, dining, story boarding and using a portable computer.

Further properties of this device are that it pivot to fold away when not in use, while the chair is still unfolded, and that it fold with and about the folded chair for transport or storage.

A tablet arm assembly comprises:

(1) A tablet arm sub assembly, having 2 tablet arm plates, 1 single pivot means, and 1 double pivot means.

(2) A connection to chair frame, having 1 double pivot means, and a means of attachment to the chair frame.

(3) Chair member point of attachment, having 1 adapted chair member B or B'.

The tablet arm is constructed of 2 rigid plates (FIGS. 53, 54; 60,61) such as of fiberboard, connected together along a joint line (62). The plates are attached about this joint by 2 pivotal means. One of these means is a rigid, single pivot, double leaf hinge (63), such as metal, with pivot line positioned upon the joint line. The other means is a double pivotal flip-flop hinge (64), such as metal, positioned such that one pivot axis (64B) is positioned at 90 degrees to the first pivot axis, on the same plane. Both these pivotal means are attached to both plates by screws.

The double pivotal means (FIG. 53; 65) connecting the tablet arm sub assembly to the chair frame is formed of two principal members, the first of which is a rectangular metal plate (FIG. 54; 65E) from which 2 flanges (65A) project to form a pivot point (65B). This plate is positioned with one of its sides parallel and adjoining the outward side edge of the tablet arm plate (61) to which the plate is attached by screws. The 2 flanges projecting from the plate are positioned along the outward side edge of the tablet arm plate (61) and are perpendicular to that surface. Each of these flanges has a hole in it positioned such that a centerline through the 2 holes is parallel to the outward side edge of the tablet arm plate. The second principal member of this double pivotal means, a rectilinear solid, is positioned between the 2 flanges. A pin inserted through the two flange holes and through a hole in this rectilinear solid forms the first pivotal axis (65B). The second pivotal axis is a cylindrical protrusion from another of the sides of the rectilinear solid (65C). The axis of this cylinder is perpendicular to the first pivotal axis.

The double pivotal means (65) is attached to the arm chair frame on member B or B'. The point of connection is located between pts. 5 and 13 on member B. It is a circular hole (66) slightly larger than the cylindrical protrusion on the double pivotal means, which is inserted through it. The pivotal means being attached to chair frame member B at this position by a screw (67) projecting thru a circular cover plate (68), the cover plate being of greater diameter than the hole in member B (66). The screw being screwed into a threaded hole (65D) in the end of the cylindrical protrusion on the double pivotal means.

Figure 71:
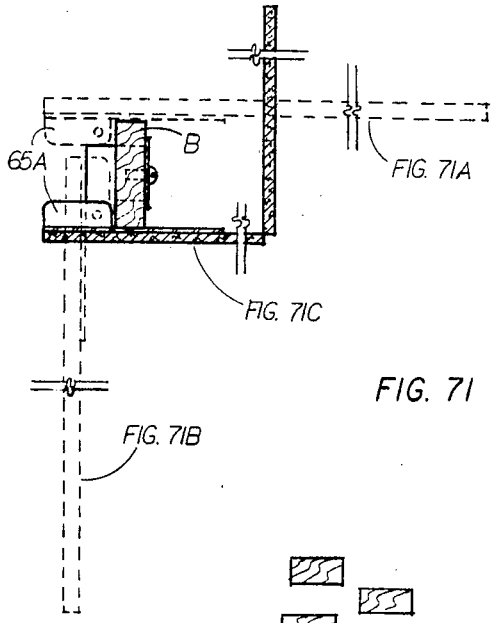
Figure 74:
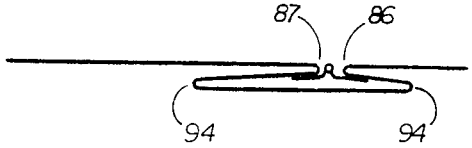
Figure 75:
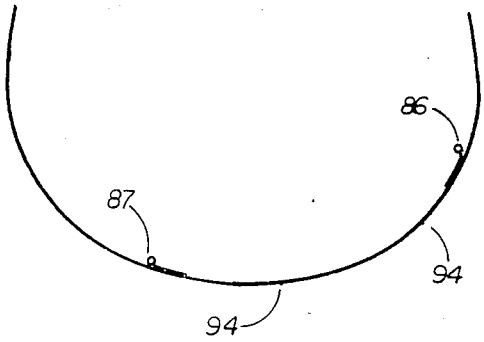

As previously described the tablet arm converts to three positions of use. The first of these is the horizontal use position wherein the tablet arm is above chair frame member B in the unfolded configuration of the chair (FIGS. 1, 52, 71A). The second position of use is that in which the tablet arm is in a vertical foldaway position outside of member B in the unfolded configuration of the chair (FIGS. 55, 71B). The third position of use is that in which the tablet arm is beneath and inside of member B in the folded configuration of the chair (FIGS. 58, 71C).

Conversion from the first use position to he second use position is effected by two rotations of the tablet arm. The first of these rotations is about pivot axis 65B, wherein the tablet arm is rotated from the horizontal (FIG. 52) to a vertical position (FIG. 53). The second rotation is about pivot axis 65C, wherein the table arm is rotated 180 degrees to the position illustrated in FIG. 55. Conversion from this second position of use to the third position of use is effected by two rotations of the tablet arm. The first of these rotations is about pivot axis 65B, wherein the tablet arm is rotated, from the folded chair position illustrated in FIG. 56, 90 degrees to the position illustrated in FIG. 57. The second rotation is about pivot axis 64A, wherein the tablet arm sub assembly plate 60 is rotated 90 degrees to that position illustrated in FIGS. 58, 71C, whereat it has been folded about the folded arm chair.

Figure 59:
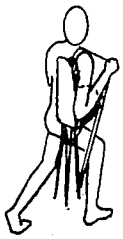

A shoulder strap attached to the chair frame permits this folded combination tablet arm chair to be carried as illustrated in FIG. 59.

PLANAR FOLD SLING

As earlier described a fabric sling slung from pts. 10,11,12 and 13 on the arm chair frame, and from pts. 14,15,16 and 17 on the straddle chair frame, can effect a seat for these chairs. Such sling seats, if of a flexible fabric quality, can fold with the chair frames, being therefore able to be retained upon the folded chair. This desireable quality is not possible with sling seats constructed of less flexible material, such as thick leather or carpeting. These less flexible slings crumple when attempting to fold them with the chair frames. The crumpling blocks the folding frame from total closure. A preferred form of this invention is a sling seat patterned such as to be able to reduce this undesireable crumpling, thereby allowing a chair with a less flexible sling seat to fold completely, with the sling seat being retained thereon. I call this a planar fold sling.

Figure 64:
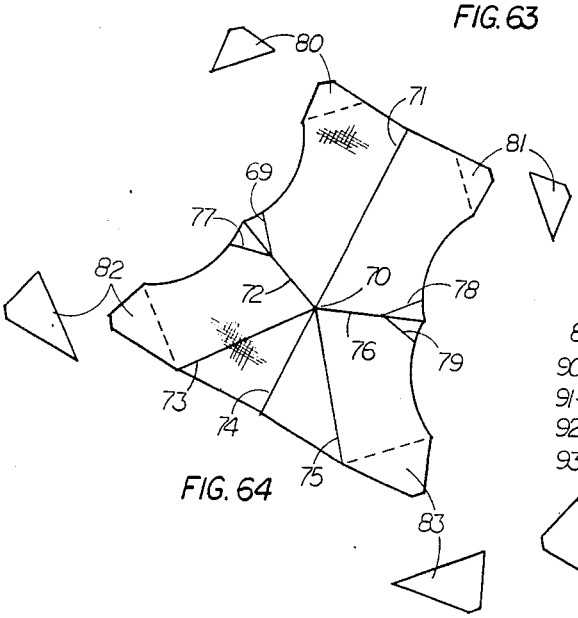

A planar fold sling seat is a fabric, or the like, seat of nominal conformation to an isosceles trapezoid, at the four corners of which, on the back sides, are sewn fabric pieces in the general shape of triangles, such as to form pockets to receive the supporting chair frame (FIG. 64; 80,81,82,83). Six fold lines radiate from a common point (70) along the longitudinal centerline of the sling. Two of these, ridge folds, extend along the said centerline away from the common point. The first (71) extends to the back of the sling. The second (74) extends to the front of the sling. Two more of these fold lines, valley folds (73,75), extend outwardly and forwardly symmetrically about the centerline, from said common point to points on the forward edge of the sling at the inward edge of the corner pockets 82 and 83. The last two fold lines, valley folds, extend outwardly and rearwardly symmetrically about said centerline, from said common point to the sides of the sling (72,76). Darts are sewn along these last fold lines for seating comfort, by sewing line 69 to line 77, and line 78 to line 79. Said common point is positioned along said centerline such as to satisfy two requirements. The first requirement being, that it lie approximately under the coccyx of the seated person in the unfolded chair, such as to provide seating comfort. The second requirement being, that it lie behind the front chair frame members, and ahead of the rear frame members in the folded chair, such as to permit complete folding of the chair frame (FIG. 63; 70).

Figure 60:
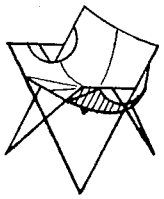
Figure 61:
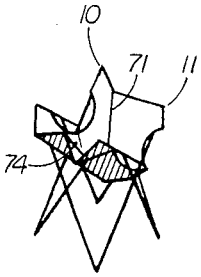
Figure 62:
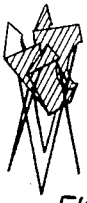
Figure 67:
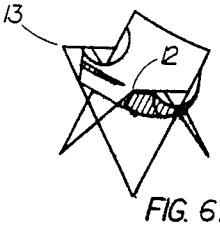
Figure 72:
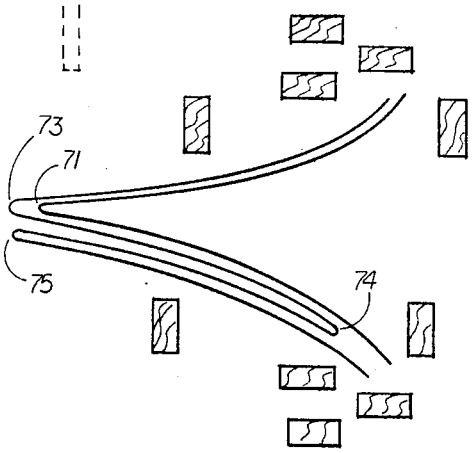
Figure 73:
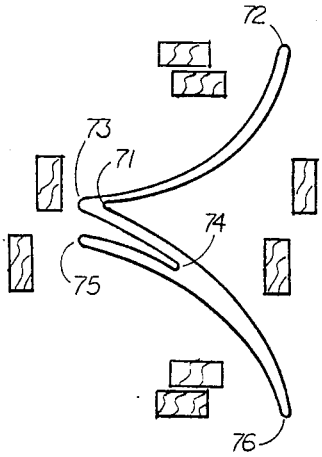

The operation of this sling invention is illustrated in FIGS. 60–63. FIG. 60 illustrates the unfolded chair with the planar fold sling. As the two upper back points of the chair frame (FIG. 61; 10,11) are pushed together, the frame folds, inducing folding of the sling along the fold lines. The two ridge folds (71,74) move toward one another, and then bypass (FIG. 62). They continue to bypass increasingly to that point where the sling is folded as figuratively described by a letter V within a letter W (FIGS. 63, 72, 73).

KNEE SOCKET SLING

Figure 69:
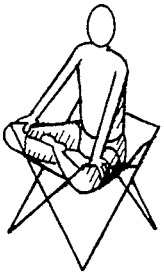

As earlier described, a fabric sling slung from pts. 10, 11, 12, 13 on the arm chair frame can effect a seat. Such slings provide one seating position, shown in FIG. 3, in which the legs would generally extend forward from the hips and one or more feet would touch the floor. A preferred adaptation of such a sling provides a second seating position, shown in FIG. 69, in which the legs extend from the hips to the side and forward to the forward corners of the sling, where the spread knees are supported in knee sockets. I call this sling, which converts from the first seating position to the second seating position, a knee socket sling.

Figure 70:
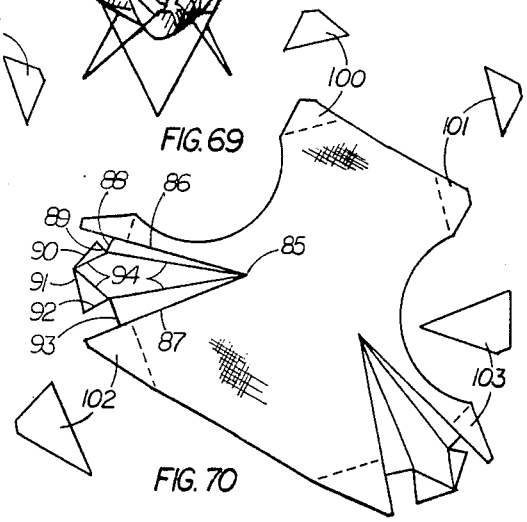

A knee socket sling is a fabric, or the like, seat of nominal conformation to an isoceles trapezoid (FIG. 70). At the four corners of the sling, on the back side, are sewn fabric pieces of triangular shape, such as to form pockets to receive the supporting chair frame (100,101,102,103). At each of the two forward corners of the sling are knee sockets. Each of these has a zipper closure. The two zipper leaves comprising one zipper are sewn along two lines (86,87) radiating outwardly and forwardly from a common point (85) to the edge of the sling. This common point on each side of the sling is positioned such as too be beneath one side of the pelvis of the seated person in the sling. Between these radiating zipper lines, is located a knee socket. The outward edge of this socket consists of a generally angular form. These angular edges are sewn together to form the socket to support a knee. This is accomplished on each socket by sewing line 88 to line 89, line 90 to line 86, line 91 to line 87, line 92 to line 93. Four fold lines (94) connect the points of intersection of the lines forming the outward angular edge of the socket (88,89,90,91,92,93), and the common point from which the zipper lines radiate (85).

The conversion of the sling from seating position 1 to seating position 2 is demonstrated in FIGS. 65–69.

(1) (FIG. 65) Seating position 1 wherein the zippers are closed, and the knee sockets are folded flat against the back side of the sling.

(2) (FIG. 66) The zippers on both sides are unzipped.

(3) (FIG. 67) The corner pockets are reversed from the bottom of the sling to the top of the sling and rehung on the arm chair frame pts. 12, and 13 to support the sling.

(4) (FIG. 68) The knee sockets are expanded. The folded knee sockets consisting of ridge fold lines 86 and 87, and valley fold lines 94, are punched out, with a fist, through the opened zipper closure, to their expanded form.

(5) (FIG. 69) Seating position 2.

HALF BREED CHAIR

This chair design has qualities of use of the previously described arm chair and straddle chair. It has an arm on one side and accommodates straddle seating on the other side. This condition is effected by using one previously described arm chair frame sub assembly in combination with one previously described straddle chair frame sub assembly, to support a sling seat.

Figure 76:
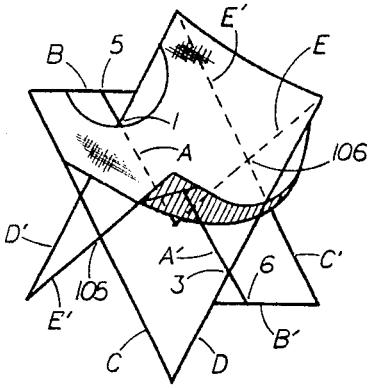

A preferred form of this invention (FIG. 76) uses a ten member folding frame consisting of an arm chair frame sub assembly of five members A,B,C,D,E pivotally interconnected at three points (1, 105, 106) to a straddle chair sub assembly of five members A',B',C',D',E'. The pivotal connection of members A and B (5) being above the pivotal connection of members A and D' (1). The pivotal connection of members A' and B' (6) being below the crossing of members A' and D (3).

Each frame sub assembly has a frame unfolding stop at the crossing of members B and D', and B' and D respectively. These are as described previously in arm chair frame A description and illustrated in FIG. 18.

This chair folds to an elongated form similar to those previously described.

While the above description contains many specificities, these should not be construed as limitations on the scope of the invention, but rather as exemplification of several embodiments thereof. Many other variations are possible. Baby strollers and rocking chairs may be constructed using 8 member frame assemblies. Baby strollers may be constructed using straddle chair frame configurations. Arm chairs may be converted to straddle chairs and vice versa. The conversion requiring inversion of the first and second members of each frame sub assembly.

I claim:

1. A foldable chair, which comprises, (A) a frame assembly, which has, (a) a plurality of substantially vertical sides, which includes (a1) two lateral sides, each of which further includes, (a1.1) first, second and third elongate brace members, wherein one end of the first brace member is pivotally connected to the substantially horizontal second brace member (5,6), the third brace member and the first brace member cross intermediae the ends of both members (1,3), and the third brace member is pivotally connected, intermediate its ends, to the first brace member (1,3), or to the second brace member at a point on the second brace member further from a first end of the second brace member (13,12) than from the pivotal connection of the first and second brace members (5,6), and (a1.2) a positional relationship of its brace members, wherein the first and third brace member crossing (1,3), is closer to the other end of the first brace member (16,15), than is a crossing of the third brace member with a longitudinal axis of the second brace member (7,8), and (a2) a third side, which further includes, (a2.1) two elongate brace members, the brace members cross and are pivotally connected to each other intermediate their ends (2), and (a2.2) a plurality of interconnections to the lateral sides, wherein one end of each third side brace member is pivotally interconnected with one end of an opposite lateral side third brace member (17,14), and the other end of each third side brade member is pivotally interconnected with the first end of an opposite lateral side second brade member (13,12), and (b) a plurality of configurations with respect to the ground, which includes, (b1) an arm chair configuration, wherein one end of each pivotally interconnected lateral side third brace member and one end of each third side brade member (17,14), together with the other end of each lateral side first brace members (16,15), form ground engaging supports for the frame assembly, and each said lateral side third brade member alternative pivotal connection intermediate its ends is to the lateral side first brace member (1,3), or (b2) a straddle chair configuration, wherein one end of each pivotally interconnected lateral side second brace member and the other end of each third side brace member (13,12), together with the other end of each lateral side third brace member (10,11), form ground engaging supports for the frame assembly, and each lateral side third brade member alternative pivotal connection intermediate its ends is to the lateral side second brace member (7,8); and (B) a sling seat supported in suspended relationship on the frame assembly.

2. The foldable chair frame assembly in arm chair configuration as recited in claim 1, in which each lateral side further comprises a crossing and pivotal stop rod connection of the second and third brace members at a second end of the second brace member, intermediate the ends of the third brace member.

3. The foldable chair frame assembly as recited in claim 2 in which each lateral side further comprises:

(a) a positional relationship of the first and second brace members with the third brace member, in which the latter is positioned between the former two members; and (b) a spacer, which is positioned between and pivotally connected to the first and second brace members at the pivotal connection of the latter two brace members.

4. The foldable chair frame assembly as recited in claim 3 further comprising a fourth side, which includes:

(a) two elongate brace members, which cross and are pivotally connected to each other intermediate their ends (4); and (b) a plurality of interconnections to the lateral sides, wherein one end of each fourth side brace member is pivotally interconnected with the other end of an opposite lateral side first brace member (16,15), and the other end of each fourth side brace member is pivotally interconnected with the other end of an opposite lateral side third brace member (10,11).

5. The foldable chair frame assembly as recited in claim 2 in which each lateral side further comprises a positional relationship of the first and second brace members with the third brace member, in which the former two members are positioned on the same side of the latter member.

6. The foldable chair frame assembly as recited in claim 5 further comprising a fourth side, which includes:

(a) two elongate brace members, which cross and are pivotally connected to each other intermediate their ends (4); and (b) a plurality of inerconnections to the lateral sides, wherein one end of each fourth side brace member is pivotally interconnected with the other end of an opposite lateral side first brace member (16,15), and the other end of each fourth side brace member is pivotally interconnected with the other end of an opposite lateral side third brace member (10,11).

7. The foldable chair frame assembly in straddle chair configuration is recited in claim 1, in which each lateral side third brace member pivotal connection to the second brace member further comprises a pivotal stop rod.

8. The foldable chair frame assembly as recited in claim 7 in which each lteral side further comprises:

(a) a positional relationship of the first and second brace members with the third brace member, in which the latter is positioned between the former two members; and (b) a spacer, which is positioned between and pivotally connected to the first and second brace members at the pivotal connection of the latter two brace members.

9. The foldable chair frame assembly as recited in claim 8 further comprising a plurality of interconnections of the lateral sides, wherein the other end of each lateral side third side brace member is pivotally interconnected to the other end of the opposite lateral side third brace member (10/11), and the other end of each lateral side first brace member is pivotally interconnected to the other end of the opposite lateral side first brace member (16/15).

10. The foldable chair frame assembly as recited in claim 8 further comprising a fourth side, which includes:

(a) two elongate brace members, which cross and are pivotally connected to each other intermediate their ends (4); and (b) a plurality of interconnections to the lateral sides, wherein one end of each fourth side brace member is pivotally interconnected with the other end of an opposite lateral side first brace member (16,15), and the other end of each fourth side brace member is pivotally interconnected with the other end of an opposite lateral side third brace member (10,11).

11. The foldable chair frame assembly as recited in claim 7 in which each lateral side further comprises a positional relationship of the first and second brace members with the third brace member, in which the former two members are positioned on the same side of the latter member.

12. The foldable chair frame assembly as recited in claim 11 in which each lateral side further comprises:

(a) a positional relationship of the first and second brace members with the third brace member, in which the latter is positioned between the former two members; and (b) a spacer, which is positioned between and pivotally connected to the first and second brace members at the pivotal connection of the latter two brace members.

13. The foldable chair frame assembly as recited in claim 11 further comprising a fourth side, which includes:

(a) two elongate brace members, which cross and are pivotally connected to each other intermediate their ends (4); and (b) a plurality of interconnections to the lateral sides, wherein one end of each fourth side brace member is pivotally interconnected with the other end of an opposite lateral side first brace member (16,15), and the other end of each fourth side brace member is pivotally interconnected with the other end of an opposite lateral side third brace member (10,11).

14. The foldable chair frame assembly as recited in claim 6, or 12, or 13, further comprising each brace member being tubular and having an elongate flexible connection running continuously through the assembly tubular brace members, wherein the pivotal connections between the assembly brace members are defined by passage of the flexible connection from the shaft of one tubular brace member to the shaft of an adjacent brace member.

15. The foldable chair frame assembly as recited in claim 8, or 9, or 10, or 11, or 12, or 13, in which each frame assembly lateral side second brace member comprises;

(a) a curving side, and (b) a positional relationship of the curving side to the ground, wherein the curving side engages the ground, permitting the assembly to rock.

16. The foldable chair frame assembly as recited in claim 4, or 6, or 9, or 13 in which each frame assembly lateral side further comprises;

(a) a first wheel pivotally connected to the first end of the first brace member, (b) a second wheel pivotally connected to the first end of the third brace member, and (c) the wheels permitting translation of the chair by rotation of the wheels.

17. The foldable chair frame assembly as recited in claim 1 further comprising a positional relationship of brace members wherein each brace member of each side of the frame assembly is positioned on the same plane as each other brace member on the same side of the frame assembly.

18. An improved lateral side brace member for a foldable chair frame assembly of the type recited in claim 17 and wherein (a) a plurality of pivotally connected brace members, (b) these members including 2 types of brace members formed of assemblies of sub brace members, (c) a first type of assembled brace member including a sub brace member bar and a sub brace member pair of gusset plates, said plated being of a shape similar to a letter Z, said first type assembled brace member being used as a third side brace member of said old element framing system, (d) a second type of assembled brace member including a sub brace member bar and a sub brace member pair of gusset plates, said plates being of a shape other than similar to a letter Z, said second type assembled brace member being used as a lateral side brace member of said old element framing system, wherein when said old element frame system is used in the fabrication of the chair frame assembly as recited in claim 17 the improved lateral side brace member comprises:

(a) a first sub brace member bar;

(b) a second sub brace member bar comprising a pair of gusset plates, said plates being of a shape similar to a letter Z;

(c) said second sub brace member plates being connected to said first sub brace member bar, said first sub brace member bar being positioned between said pair of plates at the bottom part of the letter Z of each plate, said connection of the first sub brace member bar with the second sub brace member plates being of means for rigid connection;

(d) said improved lateral side brace member being said lateral side first brace member; and (e) said improved lateral side first brace member pivotal connection to said lateral side second brace member being that wherein at point of connection said lateral side second brace member is positioned between the gusset plates of the formen brace member at the end of the top part of the Z shaped plates furthest from the middle part of the Z.

19. The foldable chair frame assembly as recited in claim 18 which further comprises a fourth side, which includes:

(a) two elongate brace members, which cross and are pivotally connected to each other intermediate their ends (4);

(b) the fourth side brace members are each positioned on the same plane; and (c) a plurality of interconnections to the lateral sides, wherein one end of each fourth side brace member is pivotally interconnected with the other end of an opposite lateral side first brace member (16,15), and the other end of each fourth side brace member is pivotally interconnected with the other end of an opposite lateral side third brace member (10,11).

* * * * *